US012398716B2

(12) United States Patent
Cowan

(10) Patent No.: US 12,398,716 B2
(45) **Date of Patent: *Aug. 26, 2025**

(54) DYNAMIC COMPRESSOR CONTROLS

(71) Applicant: Detechtion USA Inc., Houston, TX (US)

(72) Inventor: Adrian Cowan, Holland Park (AU)

(73) Assignee: DETECHTION USA INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/529,918

(22) Filed: Dec. 5, 2023

(65) Prior Publication Data

US 2024/0240629 A1 Jul. 18, 2024

Related U.S. Application Data

(63) Continuation of application No. 16/869,772, filed on May 8, 2020, now Pat. No. 11,891,990.

(60) Provisional application No. 62/850,763, filed on May 21, 2019.

(51) Int. Cl.

| | |
|---|---|
| ***F04B 49/02*** | (2006.01) |
| ***F04B 49/06*** | (2006.01) |
| *F04B 25/00* | (2006.01) |

(52) U.S. Cl.

CPC ..... *F04B 49/02* (2013.01); *F04B 49/022* (2013.01); *F04B 49/065* (2013.01); *F04B 25/00* (2013.01); *F04B 2201/0208* (2013.01); *F04B 2201/1201* (2013.01); *F04B 2205/02* (2013.01); *F04B 2205/05* (2013.01); *F04B 2205/10* (2013.01); *F04B 2205/11* (2013.01); *F04B 2207/01* (2013.01); *F04B 2207/0421* (2013.01); *F04B 2207/0422* (2013.01); *F04B 2207/70* (2013.01); *F04B 2207/703* (2013.01)

(58) Field of Classification Search

CPC ..... F04B 49/02; F04B 49/022; F04B 49/065; F04B 25/00; F04B 2201/0208; F04B 2201/1201; F04B 2205/05; F04B 2205/10; F04B 2205/11; F04B 2207/01; F04B 2207/0421; F04B 2207/70; F04B 2207/703

See application file for complete search history.

(56) References Cited

U.S. PATENT DOCUMENTS

| | | | | |
|---|---|---|---|---|
| 4,526,513 | A | 7/1985 | Bogel | |
| 9,133,851 | B2 | 9/2015 | Ebisawa | |
| 11,891,990 | B2 * | 2/2024 | Cowan | F04B 49/022 |
| 2018/0202431 | A1 | 7/2018 | Freund | |
| 2020/0208628 | A1 | 7/2020 | Sigmar | |

* cited by examiner

*Primary Examiner* — Charles G Freay
(74) *Attorney, Agent, or Firm* — Husch Blackwell LLP

(57) ABSTRACT

A dynamic compressor control is provided. The dynamic compressor control includes sensors to sense operating parameters of a compressor and a compressor analytic software package. The compressor analytic software package uses the sensed operating parameters of the compressor to generate key performance indicators. The key performance indicators are used to calculate process variables for the compressor. The dynamic compressor control uses the sensed operating parameters and the process variables calculated from the key performance indicators to provide operating alarms and/or shutdowns.

21 Claims, 15 Drawing Sheets

DYNAMIC COMPRESSOR CONTROLS

CROSS-REFERENCE TO RELATED PATENT APPLICATIONS

This application is a continuation of U.S. patent application Ser. No. 16/869,772, filed May 8, 2020, titled DYNAMIC COMPRESSOR CONTROLS, which claims the benefit of and priority to U.S. Provisional Application No. 62/850,763, filed May 21, 2019, the disclosures of which are incorporated herein by reference in their entirety.

BACKGROUND

Conventionally, reciprocating compressors (sometimes referred to as simply a compressor herein) have static pressure and temperature safety shutdowns set to protect them from exceeding manufacturer rated mechanical limits. The static pressure and temperature safety shutdown limits restrict the compressor operating range and the production potential of the system to which the reciprocating compressor is connected, such as, for example, natural gas wells. Alternatively, real-time monitoring of input variables and dynamic calculation of mechanical key performance indicators, KPIs, permits a compressor to operate over the widest suction pressure range possible, despite varying inlet, discharge and process conditions. As a result, throughput can be maximized by the ability to run to higher suction pressures, resulting in greater compressor capacity, or to pull suction pressures as low as possible, stimulating depleted wells, depending on the state of production of the field.

Reciprocating compressor packages are restricted to operating under conditions that ensure the mechanical ratings of the compressor are not exceeded. Key limits of the compressor include, but are not limited to, rod loads (both static and dynamic), degrees of reversal at the crosshead pin, net ratios and volumetric efficiencies. Additional considerations include the lowest maximum allowable working pressure, MAWP, and rated temperature of all components and vessels for each stage of compression. Finally, all compression must be accomplished within the rated power limits of the drive power source, commonly a gas driven engine or electric motor. Standard practice calls for a set of high and low pressure and temperature shutdowns on each cylinder to be programmed in the compressor safety shutdown system for prevention of catastrophic, costly equipment failures that could result should a rated limit be exceeded. However, this is commonly accomplished by static shutdowns through a compounding of worst-case scenarios that results in shutdown and control setpoints that can restrict the range of operation under normal conditions.

Thus, against this background it would be desirable to develop dynamic compressor controls.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

In some aspects of the technology, a reciprocating compressor skid is provided with a dynamic compressor control. The dynamic compressor control includes a hub, located in a control panel and configured to received sensor inputs regarding a suction-gas pressure, a discharge-gas pressure sensor for each cylinder of the reciprocating compressor, a discharge-gas temperature sensor for each cylinder of the reciprocating compressor, a compressor load signal generator, an engine load sensor, and a compressor analytic software package. The compressor analytic software package is configured to receive sensor inputs and calculate key performance indicators. The compressor analytic software package having a cylinder blowby signal generator that calculates cylinder blowby for each cylinder of the reciprocating compressor, a volumetric efficiency generator that calculates the volumetric efficiency for each cylinder of the reciprocating compressor, a rod load generator that calculates rod load for each cylinder of the reciprocating compressor, a degrees of reversal signal generator that calculates rod degrees of reversal for each cylinder of the reciprocating compressor, a net rod load signal generator that calculates the net rod load ratio for each cylinder of the reciprocating compressor. The dynamic compressor control further includes a dynamic compressor control processor that receives both sensor and generator data and determines whether any one of the sensor or generator data exceeds a alarm threshold and/or a shutdown threshold. Depending on whether the alarm and/or shutdown threshold is exceeded, the dynamic compressor control processor further provides an alarm or shutdown signal wherein the shutdown signal causes the reciprocating compressor to shutdown.

In some embodiments, the technology of the present application may include a low suction-gas pressure capacity control. The technology of the present application may include a suction valve control. The technology of the present application may include a rod reversal control. The technology of the present application may include an automated volume control pocket (or aVCP) controller.

These and other aspects of the present system and method will be apparent after consideration of the Detailed Description and Figures herein.

BRIEF DESCRIPTION OF DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Figure 1:
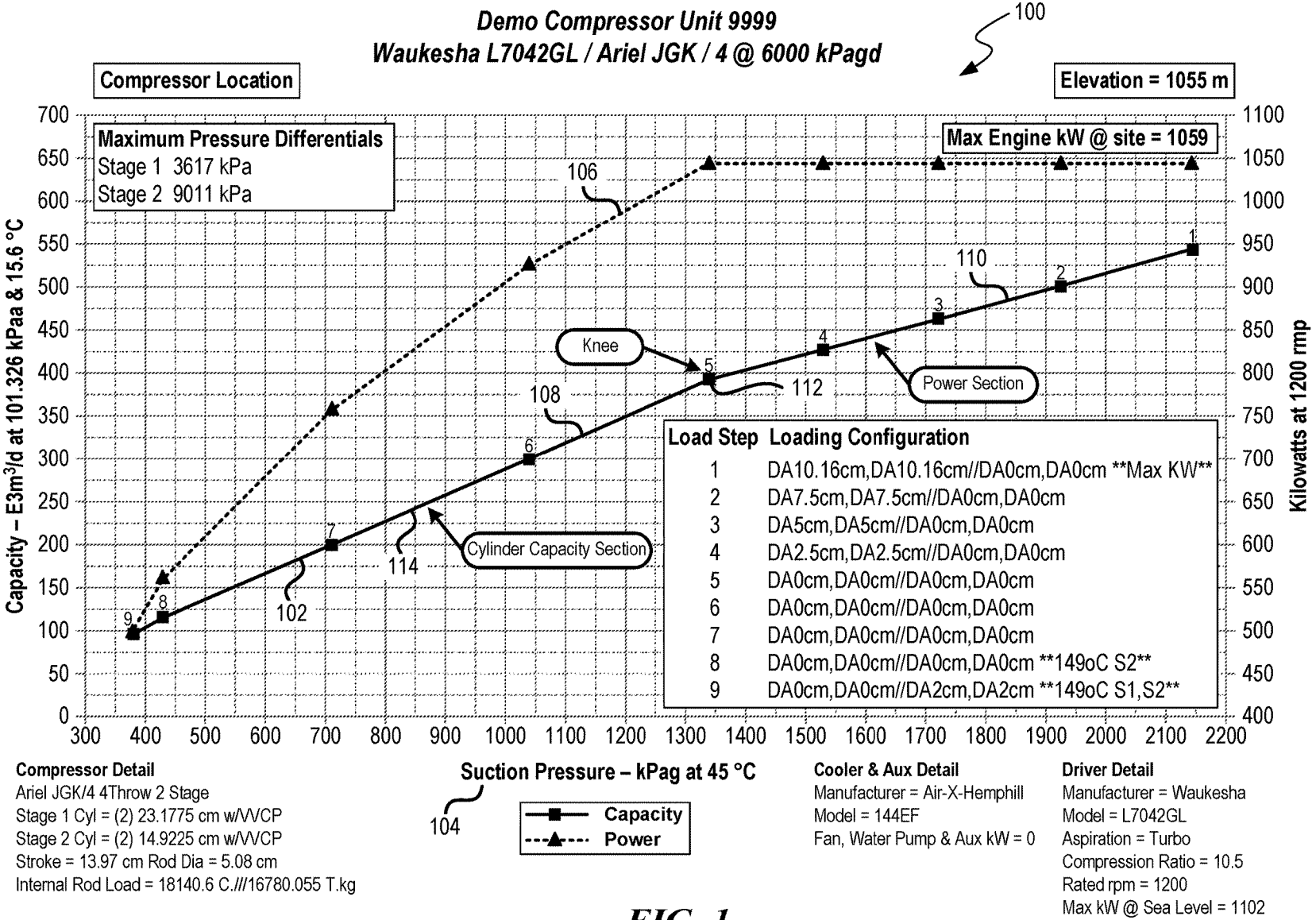
FIG. 1 shows compressor performance curves for an exemplary compressor.

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to dynamic compressor controls for a natural gas reciprocating compressor. However, the technology described herein may be used with applications other than those specifically described herein. For example, the technology of the present application may be applicable to other gases such as oxygen, carbon dioxide, hydrocarbons, other gases, or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

As mentioned above, conventional reciprocating compressors have static pressure and temperature limits that restrict the operation of the compressor. The technology of the present application provides real-time monitoring of input variables and dynamic calculation of mechanical key performance indicators (hereinafter "KPIs") that permit a reciprocating compressor to operate over a wider suction pressure range, despite varying inlet, discharge and process conditions. As a result, throughput can be maximized by the ability to run to higher suction pressures, resulting in greater compressor capacity, or to pull suction pressures as low as possible, stimulating depleted wells, depending on the state of production of the field Compressor analytics combining geometric models and thermodynamics are common place for modelling operating scenarios due to their ability to accurately calculate critical compression KPIs and limits. Integrating compressor analytics into an Industrial Internet of Things (IIoT) device, which is described as a hub device on the compressor skid below, allows for real-time calculation at the compressor skid using actual measured parameters as inputs. Calculated KPIs, such as rod load, can then be used directly as compressor safety shutdowns, negating the need for standard and conventional static shutdowns. Through the technology of the present application, the safety shutdown system will shutdown the compressor when a true machine limit has been reached under actual operating conditions rather than a worst-case scenario statically set mechanical limit.

The technology of the present application also can be applied to the suction control and recycle valve control setpoints. The suction control valve regulates rising suction pressure with increasing flowrates and the recycle valve maintains suction pressure with declining flowrates. The primary function of these two valves is to maintain an operating range within that defined by the safety shutdown setpoints. Setting a control point for each mechanical KPI below the maximum rating and using these control points for modulation of the suction control and recycle valve increases the permissible suction pressure range. This extension of the operating range results in increased use of the compressor and maximum production revenue from the field.

Reciprocating Compressor Limitation

Operating at elevated suction pressures and high throughput or at low suction pressures and reduced throughput may result in the compressor package surpassing a mechanical or material limitation. The primary limitations encountered with reciprocating compressors are explained in detail below.

Power and Speed Limitations

The compressor frame and the coupled power source (natural gas driver, electric motor, turbine, etc.) both have maximum power and speed limitations set by the manufacturer to promote safe and reliable operation. The driver power capacity is often the limiting factor with the compressor frame commonly having a power rating greater than the accompanying driver. In good compressor package design, both the compressor and the driver should be rated to the same maximum operating speed, but the technology of the present application is applicable regardless. For compressor packages where the driver and the compressor have different rated running speeds, the dynamic compressor controls should be operated at the lowest rated speed. Most compressors come with one or more modes of capacity control, which can be implemented to increase throughput when power limitations have been reached. The most common form of capacity control when operating with high power demands included:

- Variable (VVCP) and/or Fixed Volume Clearance Pockets (FVCP).
- Valve Clearance Spacers.
- Single-Acting one or more cylinders.
- Fixed Clearance Plugs.
- Cylinder or Stage Blow Through In addition to the items above, other forms of capacity control can also be used in low flow and low power operating ranges. These included, but are not limited to:

- Operating Speed
- Controlling/Varying Suction Pressure
- De-activating Cylinders/Stages.
- Recycle Valve Operation Minimum power or speed restrictions provided by the manufacturer should be considered when operating the compressor as well. Minimum operating speeds ensure that the rated torque levels can be achieved, and that proper circulation of oil and coolant occurs within the driver. Operating above minimum power limits helps to avoid glazing of the cylinders. Operating at low power requirements may lead to increased maintenance requirements.

Maximum Allowable Discharge Temperatures

During the compression process the temperature of the gas will increase. Although many factors contribute to the resulting final discharge temperature, the three most influential are the inlet suction temperature, compression ratio, and gas composition.

Inlet Suction Temperature:

- Increasing inlet suction temperature results in a higher discharge temperature.
- Decreasing inlet suction temperature results in a lower discharge temperature Compression Ratio:

Large compression ratios result in elevated discharge temperatures

Smaller compression ratios result in lower discharge temperatures

Gas Composition:

Gases with lighter molecular weights have a higher ratio of molar specific heat capacities and result in a higher discharge temperature Gases with heavier molecular weights have a lower ratio of molar specific heat capacities and result in a lower discharge temperature In standard practice, it is advisable to not exceed operating discharge temperatures of approximately 176.7° C. (350° F.), however, many compressor packages will consist of components limiting discharge temperature to lower temperatures, such as, for example, 148.9° C. (300° F.). The discharge temperature of each stage should not exceed the material temperature limits of any discharge component, including, but not limited to, the cylinder, piston, piston rings, rider bands, discharge valve plates, discharge pulsation bottles, discharge piping, and air-cooled heat exchange tubing.

Maximum Allowable Working Pressure

Components in a compressor package designed to contain gas are rated to a maximum allowable working pressure ("MAWP"). The MAWP is based on the design and material limits of the component and are specified at a maximum temperature limit. Pressures in any stage of compression should not exceed the lowest MAWP of any component used in that stage. Components with the lowest MAWP are often, but not always, the compressor cylinder, discharge pulsation bottle or the air-cooled heat exchanger.

Maximum Allowable Rod Loads

Pressures acting on the surface area of the head-end and the crank-end of a compressor piston result in a load applied to the piston. The maximum allowable compression and tension rod loads are a function of the rod diameter, compressor stroke and rod material and are called Static or Gas Rod Loads. High pressures and compression ratios will result in elevated rod loads. To ensure reliable compressor operation, the compressor should operate below the maximum allowable compression, tension and total combined rod load limits defined by the manufacturer. When compressors with large pistons are operated at high speeds and/or low compression ratios, it may be necessary to calculate the Dynamic or Net Rod Loads, which include the gas rod loads and the inertial rod load resulting from the reciprocating masses. Compression and tension net rod load limits are provided by the manufacturer.

Low Degrees of Rod Reversal

Each time the net force on the piston rod switches from compression to tension or from tension to compression, this is referred to as a cross-head pin reversal or, more simply, a reversal. Two reversals occur every full rotation of the compressor crank shaft in order to achieve proper lubrication of the cross-head pin. Reversals are measured in degrees of rotation of the crankshaft and the technology of the present application generally operates with 70° of reversal in order to exceed all manufacturers' minimum requirements. Although rod reversals will usually remain high under normal double-acting (compressing on both the head-end and crank-end of the cylinder) operation, the following occurrences will result in a decrease in reversals:

Single-Acting Cylinders.

Low RPM

Damaged Discharge Valves

High Compression Ratios

Low Volumetric Efficiencies.

Small Cylinder Bores with Large Piston Rods

Low Volumetric Efficiencies

The volumetric efficiency of a cylinder is the ratio of actual cylinder capacity to piston swept volume. Therefore, it is a measure of the proportion of the stroke that is being used to draw new gas into the cylinder and has a direct influence on the opening and closing of the compressor valves. In operating scenarios with volumetric efficiencies less than 20%, valves may not have sufficient time to fully open before the piston reaches the end of its stroke. This will result in the valve being slammed shut and decreasing overall valve life. The volumetric efficiency of a cylinder is influenced by the mechanical clearance of a cylinder (any volume not swept by the piston), compression ratio and gas composition. ISO13631/API11P standards state that, in all cases where clearance volume is added to a compressor cylinder end, the volumetric efficiency shall not be reduced to less than 15%.

Compression Health-Blowby

Blowby is an indication of the health and efficiency of the valves and piston rings inside each cylinder. It is a term that is generally used herein to quantify inefficiencies in the compression process and is a measure of the number of molecules of gas that are being re-circulated and recompressed within a cylinder. As more gas is re-circulated and recompressed, the temperature rise across the cylinder increases, more horsepower is required and the cylinder's capacity to compress gas decreases. Although blowby is not actually a limit of a compressor, the presence of blowby will often result in the compressor reaching a limit prematurely as a result of elevated suction pressures and/or discharge temperatures on the affected stage and/or elevated discharge temperature and/or rod loads on the upstream compression stage. In addition, blowby results from damaged discharge valves and can signify damaged discharge valves, which can lead to loss of crosshead pin reversals and additional damage to the compressor.

Compressor Performance Optimization

With reference to FIG. 1, a compressor performance curves 100 are shown for an exemplary compressor. The compressor performance curves 100 are a graphical representation of the optimized suction pressure operating range of a compressor given operating conditions of the compressor. The flow, as represented by capacity 102, shown on the curve is the highest throughput that is possible at the specified suction pressure 104 and the power 106 is the total required power consumption for the compression to take place.

The loading curve 108 shown in the figure below shows the optimized performance of a two-stage unit at a discharge pressure of 6000 kPag. The loading curve 108 can be divided in three segments: the power section 110, the knee 112, and the cylinder capacity section 114. As can be appreciated the knee 112 is the inflection point between the power section 110 and the cylinder capacity section 114.

The power section 110 of the curve indicates a power use of 100%. In this portion of the loading curve 108, clearance devices are generally used to unload the driver and this is translated as an increased capacity. The cylinder capacity section 114 of the loading curve 108 provides a cylinder capacity use of 100%, which means no clearance is added to the first stage cylinder(s) and the driver is running at maximum speed. The knee 112 of the loading curve 108 is the only point on an optimized loading curve 108 where the cylinder capacity use and power use are both at 100%.

Figure 2:
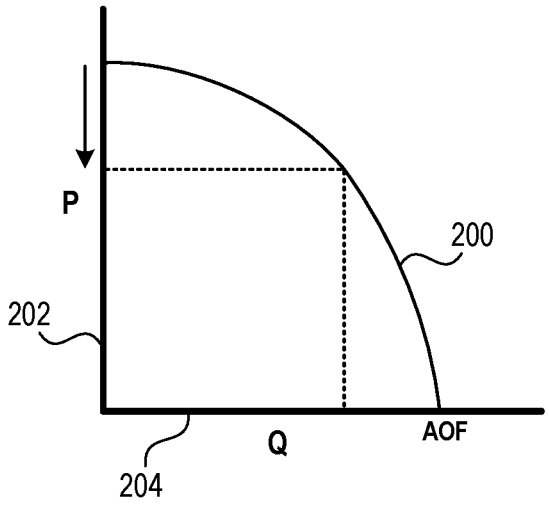
FIG. 2 shows an inflow performance relationship curve for an exemplary compressor.

Although compressor throughput generally increases with increasing suction pressure, gas well deliverability benefits from lower suction pressures. The ability of a well to flow gas increases with a decrease in flowing bottom-hole pressure, which can be directly influenced by compressor suction pressure. This relationship is represented by an Inflow Performance Relationship (IPR) curve 200 as shown in FIG. 2. An IPR curve 200 can be done for an individual well or an entire field and represents the relationship of the well or field deliverability to changes in the flowing bottom-hole pressure. A typical well IPR Curve 200 is shown in FIG. 2 as an exemplary representation, where the maximum deliverability is equivalent to the absolute open flow (AOF). The AOF is the rate at which the well would produce if there were no back pressure and is a measure of well performance and deliverability. Notice how decreasing pressure, P (y-axis) 202, results in an increase in production, Q (x-axis) 204. As shown, an increase in compressor suction pressure will result in a decrease in well deliverability and a loss of production while a decrease in compressor suction will stimulate the well deliverability and potentially increase production.

The shape of the IPR curve 200 generally varies for each well depending on reservoir characteristics. As well, the IPR curve 200 of a well will tend to shrink with continued gas production due to the resulting decrease in reservoir pressure.

Figure 3:
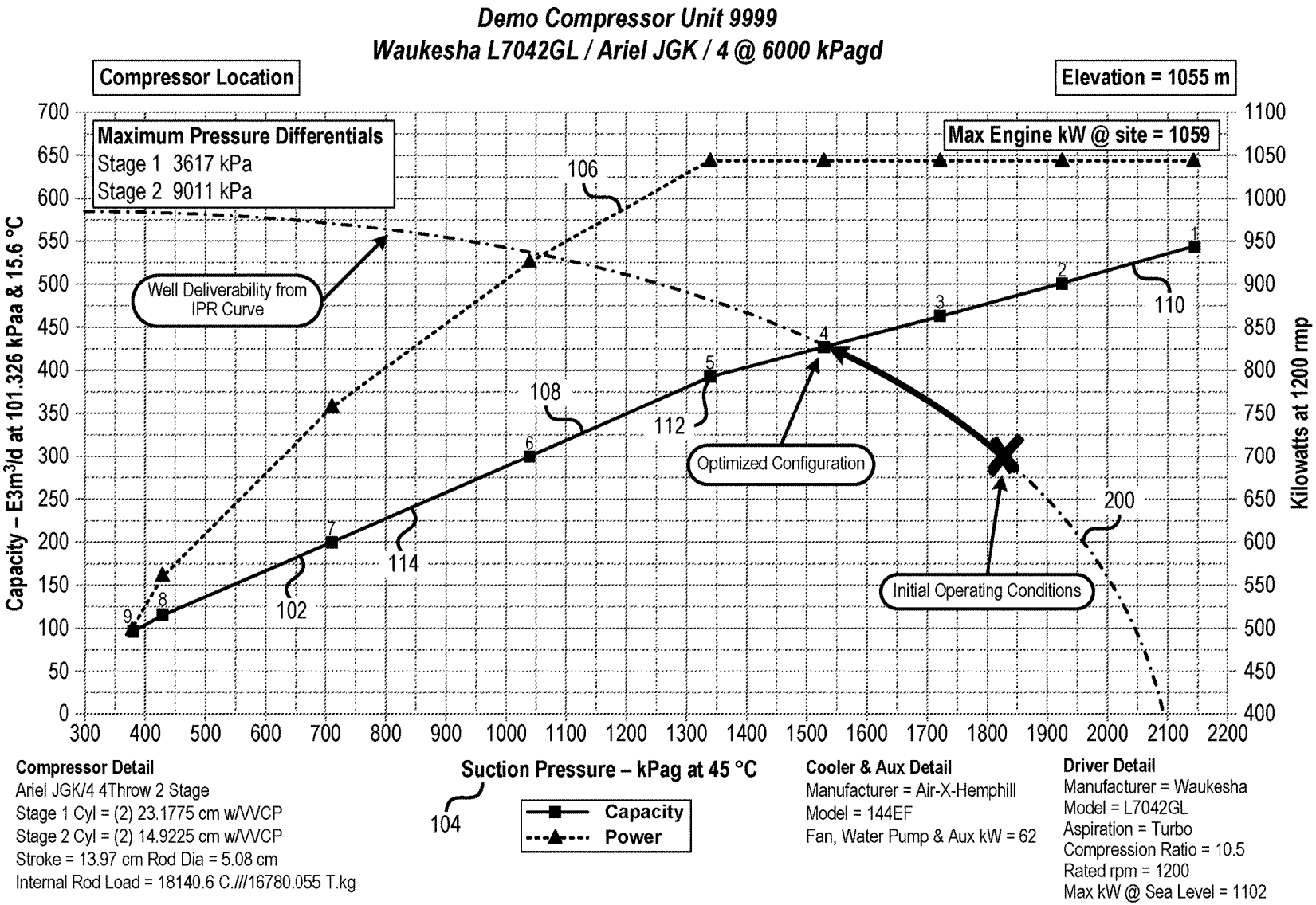
FIG. 3 shows compressor performance curves and an inflow performance relationship curve for an exemplary compressor.

Reversing the x-axis 204 and y-axis 202 of the IPR curve 200 allows the plotting of the well-deliverability curve 200 on a compressor performance curve 100 as shown in FIG. 3. Continually optimizing a compressor so that either the cylinder use or power use remains at 100% ensures operation at the point of intersection of the IPR curve 200 with the compressor performance curve 100. As the compressor performance curve 100 represents the maximum possible throughput of a compressor at any given suction pressure and a fixed discharge pressure, the intersection point of the IPR curve 200 with the compressor performance curve 100 is the optimum operating point with the current compression equipment. Any increase in suction pressure would result in a decrease in flow to the right side on the IPR curve 200. Alternatively, any decrease in suction pressure can only be obtained through additional compression capacity, obtained either by adding more compressors or by substantially modifying the current installed compressor package.

Changes in operating conditions, such as discharge pressure, flow rate, inlet suction temperature or ambient air temperature, will result in a variation of the compressor performance curve 100. When the changes are substantial, the mechanical limits of one set of operating conditions may infringe on the normal expected parameters under alternative operating conditions. Therefore, compressors require a safety system designed to shutdown the compressor prior to the breach of any design limit.

Safety Shutdown System

Compressor safety shutdown systems consist of pressure, temperature and vibration sensors combined with a set of annunciators and switches. Alarm and shutdown triggers (or thresholds) are applied to sensors to prevent operating under conditions that may exceed compressor rated limits. Alarms provide a warning to an operator that a limit is being approached, while triggering a shutdown will immediately cease the operation of the compressor.

Some requirements of these shutdowns, alarms, annunciators and switches are set by an ISO standard, such as, for example, ISO13631/API11P, which is incorporated herein by reference as if set out in full. Although some of the requirements laid out in the standards are specific, the application of the standard is general. Some of the relevant excerpts of the ISO1361 standards are provided below.

ISO 13631:2002

Shutdowns, Alarms and Annunciators 14.1 General

An alarm/shutdown system shall be provided which initiates an alarm if any one of the conditions specified by the purchaser as alarm conditions reaches an agreed alarm level. This system shall also initiate shutdown of the compressor when any of the conditions specified or recommended as shutdown conditions reaches an agreed shutdown level. Shutdown and alarm systems shall be designed to operate in a fail-safe mode.

The systems may function hydraulically, pneumatically, electrically or in any combination, as specified by the purchaser.

Unless otherwise agreed, for every shutdown function an alarm function shall be provided and set at a value which represents a deviation from the normal condition and less than the setting of the shutdown. Additional alarms, not associated with shutdowns, shall be provided as specified.

14.2 Minimum Required Shutdowns

The conditions at which shutdown is required, as a minimum, are specified in Table 7.

TABLE 7

Figure 4:
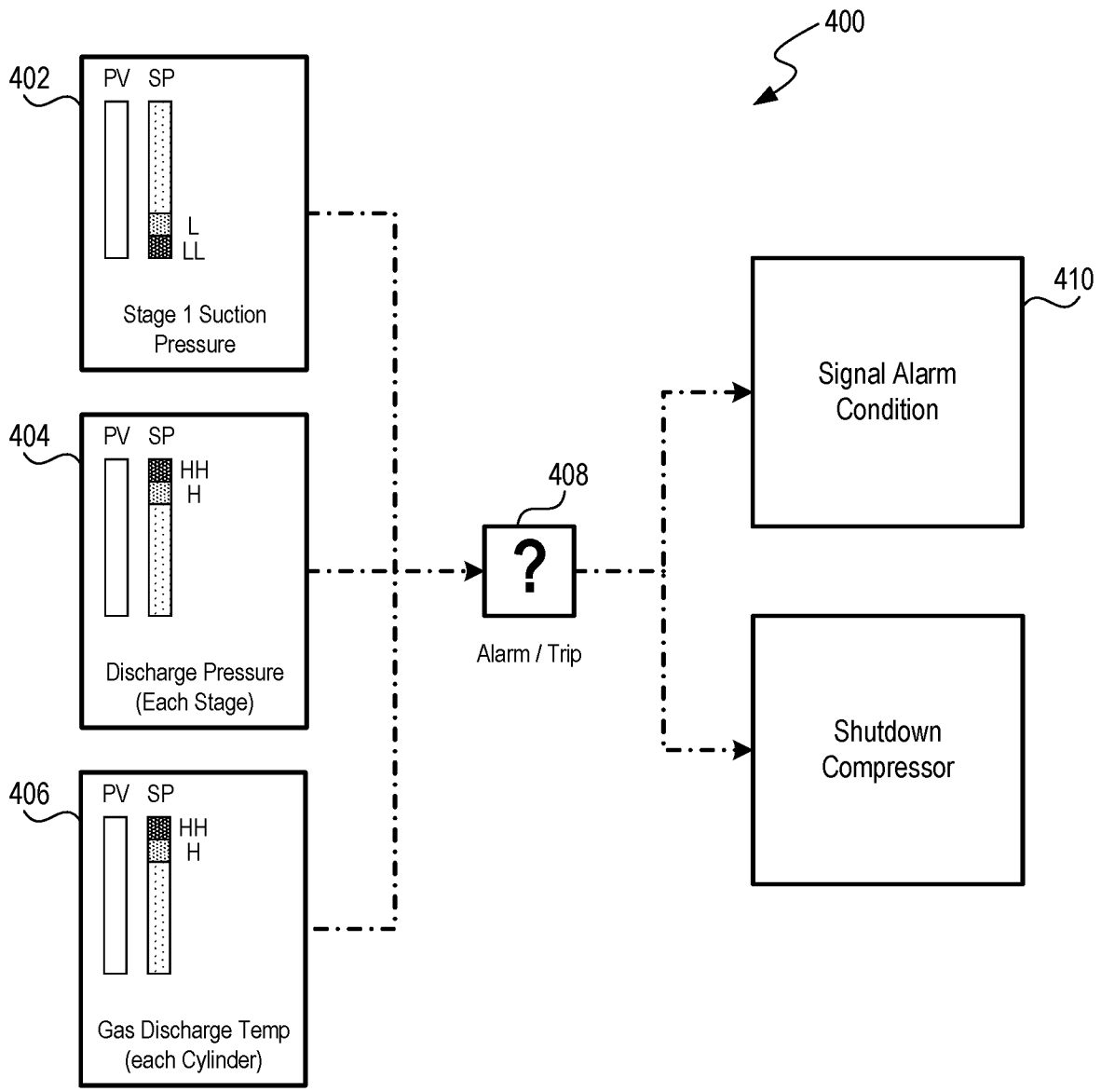
FIG. 4 (Prior Art)
FIG. 4 shows a safety shutdown and alarm system.

FIG. 4: ISO 13631—Minimum shutdown requirements

| Alarm-level condition | Shutdown |
|---|---|
| Engine: | |
| Low fuel-gas pressure | X |
| High fuel-gas pressure | X |
| High cooling-water temperature | X |
| Low lubricating-oil pressure | X |
| Overspeed | X |
| High vibration | X |
| Motor: | |
| High stator-winding temperature | X |
| High vibration | X |
| Compressor: | |
| Low suction-gas pressure | X |
| High discharge-gas pressure (each stage) | X |
| Cylinder lubricator failure | X |
| Low lubricating-oil pressure | X |
| High discharge-gas temperature (each cylinder) | X |
| High vibration | X |
| Other: | |
| High cooler vibration | X |
| High liquid level in inlet and interstage separators | X |
| Low-cooling-water level | X |

14.3 Additional Alarms and Shutdowns

The extent to which the alarm and shutdown systems shall be supplied by the vendor shall be specified by the purchaser on the data sheets.

14.4 Annunciators

Each component which actuates an alarm or a shutdown shall also actuate an annunciating device which indicates first-out cause of alarm or shutdown. Annunciators shall be bypassed only for the purpose of a preset-time lock-out for use on certain shutdown devices during start-up and manual testing. The vendor shall specify the type and size of annunciator, the shutdowns and alarms to be annunciated, the number of spare points on the annunciator panel and the type of warning (audible or flashing light or both) for alarms and shutdowns.

14.7 Shutdown and Alarm Settings

Shutdown and alarm settings shall be mutually agreed upon by the purchaser and vendor.

Standard Shutdown and Alarm Settings

To facilitate an understanding of the technology of the present application, conventional or standard shutdown and alarm settings are herein explained.

Changes in operating conditions of the compressor will result in corresponding changes to the pressures and temperatures in the compressor. When the changes are substantial, the mechanical limits of one set of operating conditions may overlap with the normal expected parameters under alternative operating conditions. Consideration should be given to these situations such that the compressor safety shutdown system is able to protect the compressor over the entire operating range of the compressor.

Conventionally, the protection of any compressor meeting the minimum requirement for safety shutdowns, as specified in the aforementioned ISO13631/API11P, depends on the static shutdown trip settings on the following monitored process parameters:

Low (Stage 1) suction-gas pressure.

High discharge-gas pressure (each stage).

High discharge-gas temperature (each cylinder)

A safety shutdown system consisting of only the minimum shutdowns requires the low (Stage 1) suction-gas pressure and high discharge-gas pressures (each stage) to be set to protect the compressor from exceeding all compressor limitations, other than maximum allowable temperature, previous described. Therefore, these settings will often be conservative for normal operating conditions, thus restricting the permissible operating range. For example, a compressor that normally discharges into a pipeline at 8000 kPag may not reach rod load limits until the inlet suction pressure has declined to 300 kPag. However, the low suction-gas pressure may be limited to only 800 kPag, as rod load limits would be reach at this pressure at the pipeline's maximum operating pressure of 10,000 kPag FIG. 4 shows a safety shutdown and alarm system 400 for a compressor (not specifically shown). The safety shutdown and alarm system 400 includes a suction-gas pressure sensor 402 to monitor the intake suction-gas pressure, a discharge-gas pressure sensor 404 for each stage of the compressor, and a discharge-gas temperature sensor 406 for each stage of the compressor. Typically, there is one suction-gas pressure sensor 402 and multiple discharge-gas pressure sensors 404 and discharge-gas temperature sensors 406. Each of the sensors 402, 404, and 406 provides an input to an alarm/trip processor 408. The alarm/trip processor 408 compares each sensor input to corresponding thresholds (an alarm threshold for an alarm point and a shutdown threshold for a trip point (the alarm threshold and/or shutdown threshold may be referred to as a first threshold and/or a second threshold; however, the terms first and second are simply to distinguish one threshold from the other and should not be considered limiting)). If the alarm/trip processor 408 determines that any one of the sensors 402, 404, or 406 provided input that violates an alarm threshold, the alarm/trip processor causes an alarm 410, which may be a visual, audio, or audio/visual alarm. If the alarm/trip processor 408 determines that any one of the sensors 402, 404, or 406 provided input that violates trip threshold, the alarm/trip processor causes the compressor to shutdown.

Figure 5:
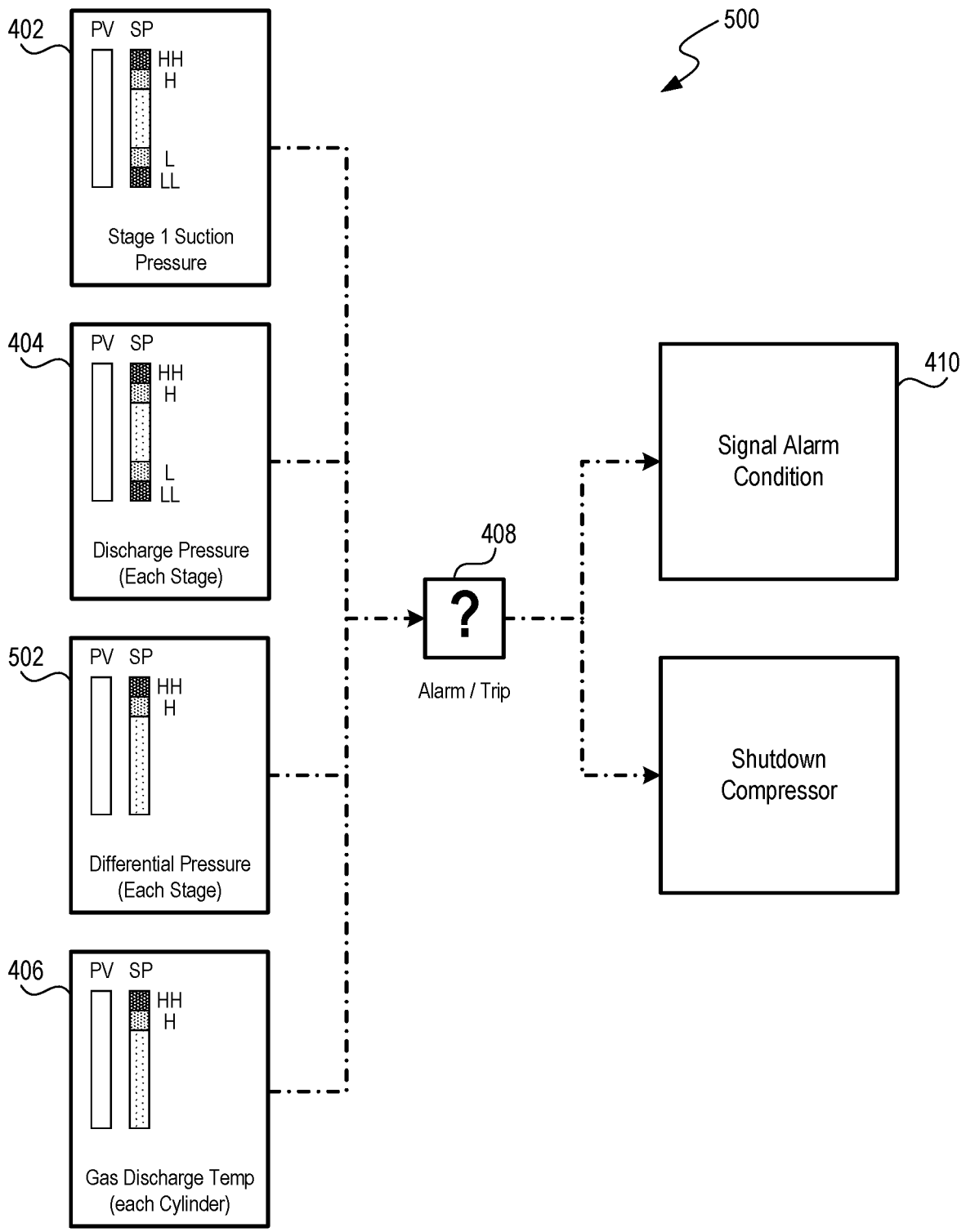
FIG. 5 (Prior Art)
FIG. 5 shows a modified safety shutdown and alarm system.

The safety shutdown and alarm system 400 may be modified to include additional sensors as shown in a standard shutdown and alarm system 500 in FIG. 5. The limitations to the operating range can be reduced by adding alarm and shutdown settings on the following monitored process parameters:

High (Stage 1) suction-gas pressure

Low discharge-gas pressure (each stage).

Differential Pressure (each stage)

Shutdowns on these process variables provide increased protection against high rod loads and low volumetric efficiency. This permits a greater overall compression ratio between the low (Stage 1) suction-gas pressure and the High discharge-gas pressure shutdowns, as the focus of these shutdowns shifts towards material limits of the components, such as MAWP. This results in an increase to the permissible operating range of the compressor under most scenarios. As shown in FIG. 5, the standard shutdown and alarm system 500 includes a suction-gas pressure sensor 402 to monitor the intake suction-gas pressure, a discharge-gas pressure sensor 404 for each stage of the compressor, and a discharge-gas temperature sensor 406 for each cylinder of the compressor similar to system 400 above, but also includes differential pressure sensor 502 for each stage of the compressor. Additionally, the suction-gas pressure sensor 402 now monitors both for low pressure conditions as well as high pressure conditions. Similarly, the discharge-gas pressure sensor 404 for each stage of the compressor now monitors for both high pressure conditions as well as low pressure conditions.

There are at least two common philosophies for setting the high discharge-gas temperature trip point for each cylinder: (1) trip set to lowest maximum rated temperature of the stage, which is often the rated operating temperature of the valve plate material but can also be the rated temperature of a discharge vessel (cooler, piping, pulsation bottle) when PEEK high-temperature valves are used and (2) trip set to small margin above the normal operating temperature, which provides for early protection against valve failures and/or process upsets. While the latter philosophy provides superior protection, the former will result in a broader operating range and a reduction in compressor trips. The correct philosophy for any compressor will depend on the instrumentation and communication systems present and the type and extent of condition monitoring conducted.

The following is an example procedure for determining safety shutdowns and alarms for the standard shutdown and alarm system 500, although many variations exist, the below is provided to facilitate an understanding of the technology of the present application.

1. Determine the final stage high discharge-gas pressure shutdown (PSHH)
   Must exceed highest expected discharge line pressure
   Must be less than final stage MAWP
2. Determine appropriate modeling conditions
   Highest expected Stage 1 suction temperature
   Highest expected interstage suction temperatures
   Anticipated interstage pressure drops
3. Determine desired compressor configuration
   Required cylinder action (ie. Double-acting, single-acting, etc.)
   Added clearance required (ie. Variable volume control pockets, spacers, etc.)
4. Determine high discharge-gas temperature shutdown for each stage 5. Determine high pressure shutdowns for each stage
   At final stage PSHH, model increasing suction pressure until limit reached on any stage
6. Determine Stage 1 low discharge-gas pressure (PSLL) shutdown at PSHH
   At final stage PSHH, model decrease suction pressure until limit reached on any stage
7. Determine interstage low discharge-gas pressures
   Interstage pressures at lowest expected operating discharge pressure and Stage 1 PSLL
8. Determine maximum allowable differential pressure for each stage
   Minimum differential pressure for each stage at which rod load limits are reached
   Determined by vendor or 3rd-party software
9. Determine alarm settings for each shutdown
   Set at appropriate margin shutdown considering:
   i. Suction and Recycle valve Controller response time-digital controllers are generally faster acting than local pneumatic controller
   ii. System dynamics-how quickly can process conditions change if the controller fails to rectify the process upset
   iii. Operator response time-allow enough margin for an operator to respond and intervene Control System—Suction and Recycle Valve Setpoints While the purpose of the safety shutdown system is to prevent the breach of any design limit, control points are used to prevent process variables from reaching their shutdown trip, thereby maintaining safe and continuous operation of the compressor. Control points are most commonly set on the following process variables:

Low (Stage 1) suction-gas pressure

High (Stage 1) suction-gas pressure.

High discharge-gas pressure (final stage, PSHH)

Figure 6:
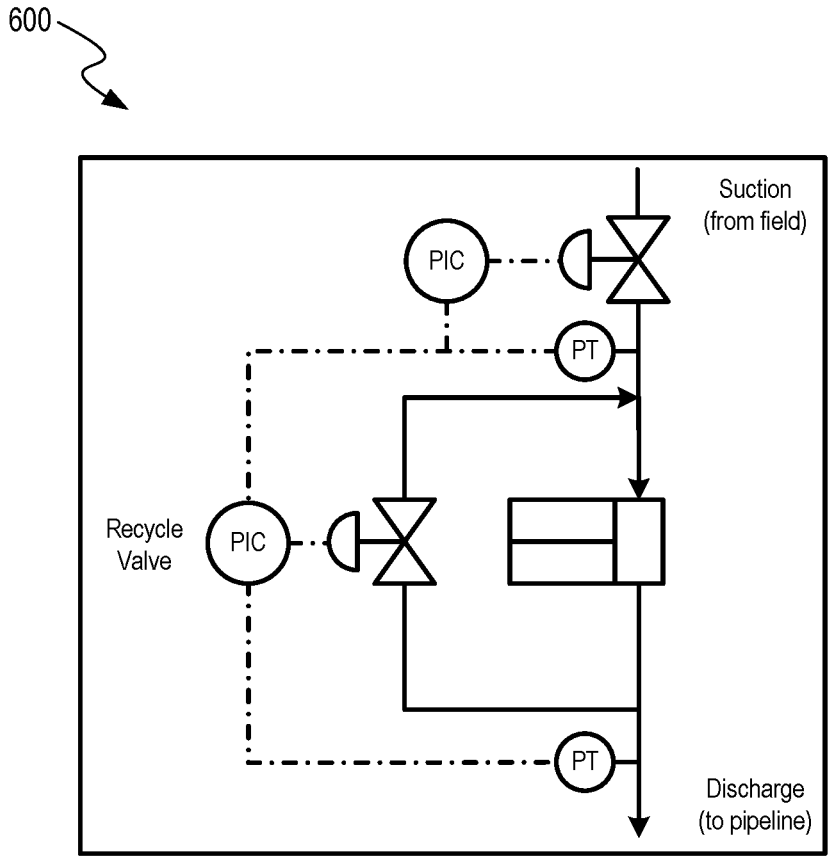
FIG. 6 (Prior Art)
FIG. 6 shows a compressor suction and recycle valve.
Figure 7:
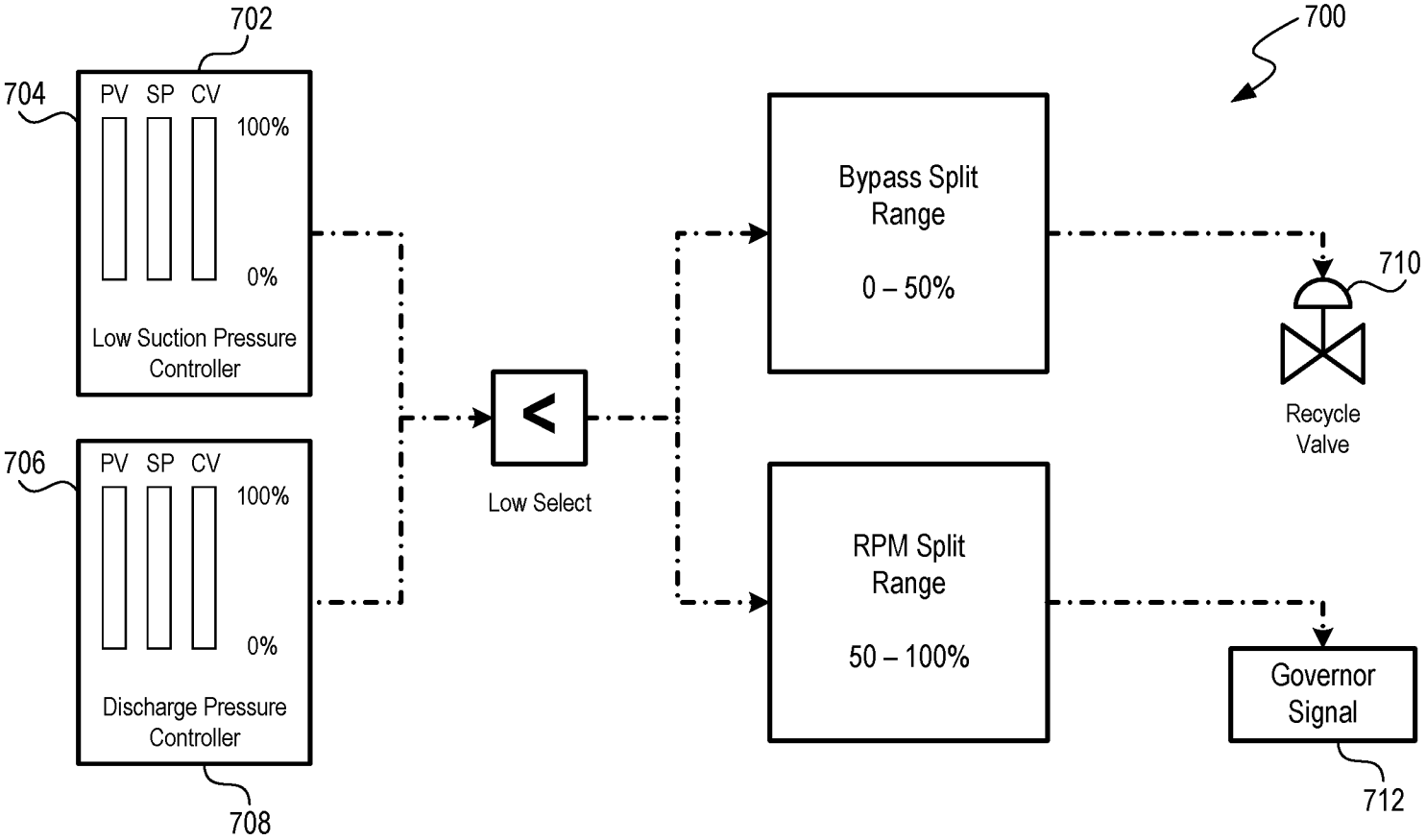
FIG. 7 (Prior Art)
FIG. 7 shows a capacity control system for the driver RPM and recycle valve.
Figure 8:
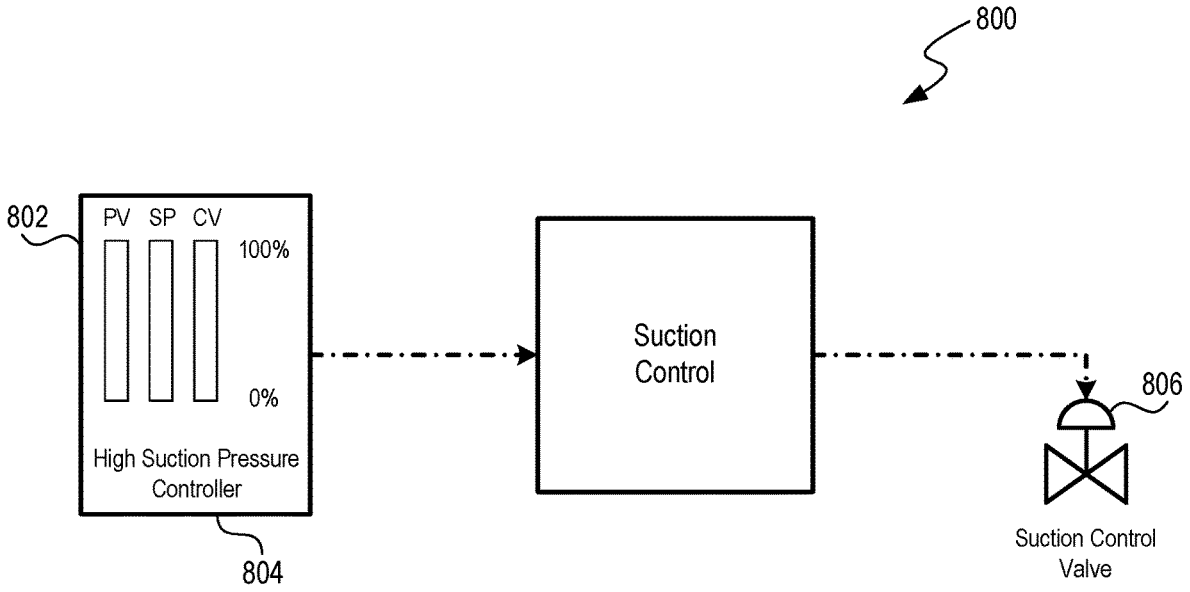
FIG. 8 (Prior Art)
FIG. 8 shows a capacity control system for the suction control valve.

Whereas alarms are set at a margin to each shutdown trip point, control points are set at a margin from the first acting shutdown trip point. For example, if declining suction pressure will result in high discharge temperature before any other limit is reached, then the low control point will be set at a pressure to prevent the maximum rated discharge temperature being exceeded. Reaching a control point will modulate the suction control or recycle valve or, in some instances, reduce the driver speed. The function of these two valves, combined with variation in driver speed, is to maintain an operating range within that defined by the safety shutdown system shutdowns. The suction control valve regulates rising suction pressure with increasing flowrates and primarily serves to protect against driver power limits and high Stage 1 rod loads. The recycle valve maintains suction pressure with declining flowrates and primarily protects against rising discharge temperature, high rod loads and low volumetric efficiencies. Reduction in the driver RPM serves to reduce compressor capacity in order to prevent further declines in suction pressure or increases in discharge pressure due to excessive pipeline packing. FIG. 6 shows a schematic of a compressor suction control and recycle valve 600. FIG. 7 shows a capacity control system 700 for the driver RPM and recycle valve, and FIG. 8 shows a capacity control system 800 for the suction control valve.

The capacity control system 700 provides a gas-suction pressure sensor 702 and controller 704, a gas-discharge pressure sensor 706 and controller 708. The gas-suction pressure sensor 702 and controller 704 as well as the gas-discharge pressure sensor 706 and controller 708 receive pressure information and process that information to be used to control the throttle opening of the recycle valve 710 and the governor control 712. The governor control 712 controls the driver speed. Depending on the present speed and throttle opening position, the controllers 704/708 either opens/closes the throttle opening (when the range is 0-50% generally) or increase/decrease the driver speed (when the range is 50-100% generally). The control loop of the capacity control system 700 as shown in this FIG. 7 aims to maintain a predetermined minimum suction pressure despite declining upstream deliverability or to reduce compressor throughput to limit increases in discharge pressure caused by excessive line packing. In order to minimize fuel gas or electricity usage, the primary response is a reduction in driver speed. If the driver speed is reduced to the minimum rated speed, the secondary response is to open the recycle valve. If the control value results in the driver operating at minimum RPM and the recycle valve fully open, then the control system may be unable to prevent a shutdown condition being reached and tripping the compressor.

The capacity control system 800 provides a gas-suction pressure sensor 802 and a suction valve control 804 that receives the pressure data from the gas-suction pressure sensor 802. If the pressure data indicates the gas-suction pressure is over a threshold, the suction control 804 will signal the suction control valve 806 to close. The high suction pressure control setpoint is set to protect against overloading the driver and from exceed Stage 1 rod loads. If the setpoint is reached, the controller will send a signal to the suction control valve to close. This will limit the capacity of the compressor and prevent further increases in the Stage 1 suction pressure.

Limitations of Standard Shutdown and Control Setting

Standard compressor safety shutdown systems use static pressure and temperature trip points. The static pressure and temperature trip points are set assuming a "worst-case" scenario of operating conditions. The most important consideration in determining all shutdown and alarm settings is the required final stage high discharge-gas pressure shutdown, PSHH. This value must be high enough to accommodate anticipated increases in discharge pressure. However, a PSHH that is unnecessarily high will negatively impact the operating range by limiting other shutdown settings. A high PSHH will result in an elevated PSLL, as discharge temperature, volumetric efficiency and rod load limits will be reached sooner due to the increased compression ratio. This will necessitate a higher recycle valve control point, minimizing the ability of the compressor to pull down suction pressure and stimulate declining fields. A high PSHH will also reduce maximum throughput by lowering the high suction control point to prevent high driver power requirements.

Thus, all control, alarm and shutdown points calculated based on a static PSHH will be conservative whenever the operating discharge pressure is less than the PSHH.

Assumed Stage 1 and interstage temperatures also limit the upper and lower range of operation. Elevated temperatures will result in high discharge temperatures being calculated earlier on declining suction pressure and low temperatures will calculate high engine loads at lower suction pressures when high throughput is desired. In summary, in order to protect the compressor under all conditions, shutdown, alarm and control settings using static variables will result in a conservative compromise under most normal operating conditions.

Realtime Compressor Performance and Dynamic Compressor Control

As mentioned with above, compressor performance metrics are obtainable by a variety of existing compressor analytic software packages, such as, for example, ENALYSIS®, which is a SaaS from Detechtion USA Inc. The compressor analytic software packages accurately calculate the compression KPIs. In addition to calculating the compression KPIs, the compressor analytic software packages may determine other process variable such as, for example, power for compression used, total power used, driver power used, cylinder capacity use, incremental production possible. The compressor analytic software packages may determine certain per cylinder metrics and process variables such as, for example, blowby efficiency, expected discharge temperature, temperature rise, compression ratio, volumetric efficiency (head-end and crank-end), rod load (compression, tension, and total), net rod load (compression and tension), cylinder power, cylinder flow, degrees of reversal, net rod load ratio, and the like.

Every input and output variable in compressor analytic software package may be provided with a warning (high and low), a severe alert (high and low), and potential a shutdown trigger. The alerts warn of an approaching or breached limit.

Because the technology of the present application operates in real (or near real) time, the monitoring and processing of the information should be with as little delay as possible. Thus, the technology of the present application provides a Hub that mounts inside the compressor panel and connects instantly to existing controllers, annunciators and/or pyrometers. With the expansion I/O board, the Hub can provide full compression control on-skid. With multiple, built-in wireless communication options, the Hub allows for data monitoring, control and backhaul anywhere in the service system, such as, for example, an oilfield.

The technology of the present application uses the compressor analytic software package with the on-skid monitoring and control capabilities of the Hub to create an edge computing environment capable of transforming compressor protection, control and optimization. The edge computing environment allows for real-time monitoring of all compressor input process variables and dynamic calculation of each performance variable, identifying the exact current state of the equipment. These additional variables within the edge computing environment are used as inputs to both the safety shutdown and control systems to increase the level of protection and the operating range of the compressor, while minimizing future engineering work required to adapt to changes in configuration or operating conditions.

As mentioned previously, standard safety shutdown systems rely on a set of static setpoints on a small set of monitored process variables to protect the compressor from exceeding any material or mechanical limitation across all possible operating conditions. These settings will often be conservative for normal operating conditions, thus restricting the operating range. Instead of relying on static pressure setpoints, the edge computing environment of the present technology combines all monitored input process variables and process variables calculated by the compressor analytic software package to provide superior protection to the compressor and maximize the permissible operating range.

Figure 9:
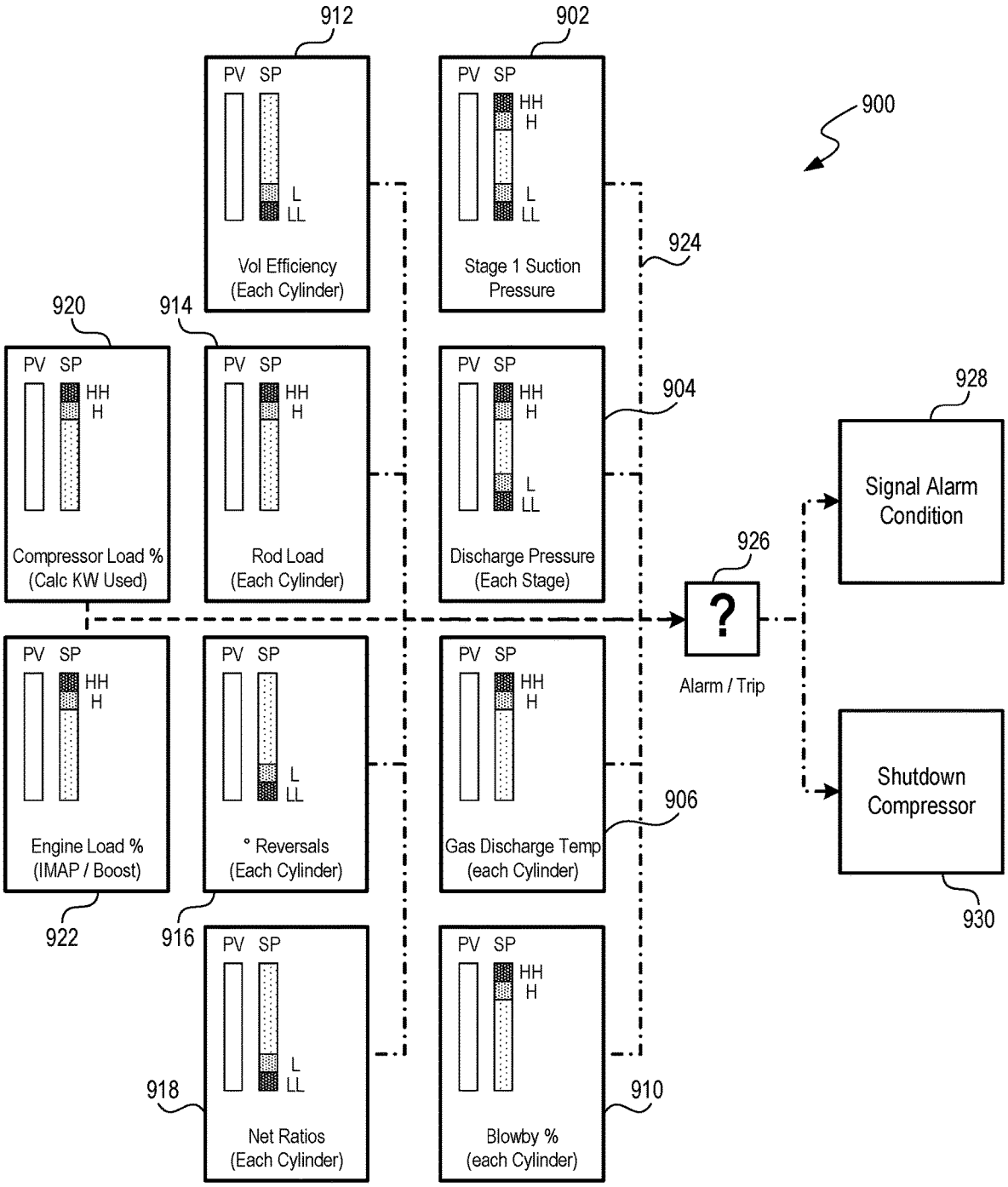
FIG. 9 shows a dynamic compressor control system.

FIG. 9 shows a dynamic compressor control system 900 consistent with the technology of the present application. Dynamic compressor control system 900 includes a suction-gas pressure sensor 902, at least one discharge-gas pressure sensor 904 (generally 1 for each stage of the compressor), at least one discharge-gas temperature sensor 906 (1 for each cylinder); at least one cylinder blowby signal generator 910 (1 for each cylinder), at least one volumetric efficiency signal generator 912 (1 for each cylinder), at least one rod load signal generator 914 (1 for each cylinder), a least one degrees of reversal signal generator 916 (1 for each cylinder), a net rod load ratio signal generator 918 (1 for each cylinder), a compressor load signal generator 920, and an engine load sensor 922. As can be appreciated, the sensors monitor real-time conditions of the compressor and the signal generators use the process outputs regarding the KPIs from the compressor analytic software package. The sensors and signal generators (902, 904, 906, 908, 910, 912, 914, 916, 918, 920, and 922) provide control signal inputs 924 to a dynamic compressor control processor 926 that compares the sensor and signal generated data to determine whether an alarm threshold or a shutdown threshold for each of the sensor or signal generated variables has been violated. Each of the sensors and signal generators may include or be combined with an associated controller and processor to process the data for use by the dynamic compressor control processor 926. The alarm threshold and shutdown threshold are established by settings associated with the compressor performance curves and calculated by the compressor analytic software package. If the alarm or shutdown threshold has been violated, the dynamic compressor control processor 926 generates either an alarm 928 or a shutdown 930. The alarm threshold and shutdown threshold setting are calculated by the compressor analytic software package and set as shown in exemplary table 1 below.

Each process variable, whether monitored or calculated, is programmed with a high and low alarm and shutdown limit, as required. This allows for variance in compressor operating conditions until an actual limit is reached, rather than presumed based on pre-determined conditions, as is the case with standard systems. With an edge computing environment, the specific limiting variable is the explicit trigger of an alarm or shutdown condition.

The inclusion of all process variables into the safety shutdown system allows the small set of process variables used in the standard systems to explicitly protect their respective relevant mechanical or material limit, rather than protecting all limits. A low suction-gas pressure can be reduced to protect minimum upstream process requirements, such as water handling, or from pulling suction vessel into a vacuum, for which most are not rated. The high suction-gas pressure can be raised so that it only protects against exceeding the lowest MAWP of all suction vessels and piping, as it no longer must protect against driver overpower or high rod loads. Similarly, the high discharge-gas pressure of each stage can be raised to the minimum MAWP of the discharge vessels and piping.

The warning and alerts shown in the table below are exemplary defaults for edge computing environment to provide dynamic control of the compressor based on real-time data. More conservative custom settings may be required based on the age of the equipment and the telemetry installed.

TABLE 1

| LoLoAlarm | LoAlarm | Name | HiAlarm | HiHiAlarm |
|---|---|---|---|---|
| | | Universal Monitored Inputs | | |
| 0% | 100% Engine Min RPM | Driver Speed | 100.5% Engine Max RPM | 101.5% (Electric)/ 103% (Gas) of Engine Max RPM |
| — | — | Recycle Valve | 2% | 100% |
| 0% | 98% | Suction Control Valve | — | — |
| | | Throw Monitored Inputs | | |
| 100% of min allowable process pressure | 95% of min allowable process pressure | Suction Pressure | 90% of min inlet MAWP | 95% of min inlet MAWP |
| — | — | Suction Temperature | — | — |
| — | — | Discharge Pressure | 90% of min: Cylinder MAWP Discharge piping MAWP Cooler pressure MAWP PSV Setting | 95% of Stage min: Cylinder MAWP Discharge piping MAWP Cooler pressure MAWP PSV Setting |
| — | — | Discharge Temperature | min (−10 F./5.556 C. ): Max piping bottle temp Max valve temp Max cooler design temp | min: Max piping bottle temp Max valve temp Max cooler design temp |
| | | Universal Calculated Values | | |
| 10% | 30% | Horsepower Utilized | 100% | 103% |
| 10% | 30% | Horsepower Utilized @ RPM | 100% | 103% |
| 0% | 30% of Frame max Power | Engine Horsepower Used | 100% of Min (Engine/Frame max power) | 103% of Min (Engine/Frame max power) |
| 0% | 100% of Frame Min RPM | Compressor Speed | 100.5% of Frame Max RPM | 103% of Frame Max RPM |
| | | Throw Calculated Values | | |
| — | — | Rod Load Compression | 95% | 99.90% |
| — | — | Rod Load Tension | 95% | 99.90% |
| — | — | Total Internal Rod Load | 95% | 99.90% |
| — | — | Net Rod Load Compression | 95% | 99.90% |
| — | — | Net Rod Load Tension | 95% | 99.90% |
| −99% | −7% | Blowby | DA: 7% SA: 15% | DA: 15% SA: 20% |
| 15% | 20% | Volume Efficiency Head-End | — | — |
| 15% | 20% | Volume Efficiency Crank-End | — | — |
| 60 degrees | 70 degrees | Min Degrees Reversal | — | — |
| 35% | 40% | Min Net Rod Load Ratio | — | — |
| 10 F./5.556 C. | 25 F./13.889 C. | Hydrate Temp Delta | — | — |

As all limits in edge computing environment are based on percentages of maximums or minimums, there is no need for time consuming engineering or management of change work to change setpoints should the compressor configuration or operating conditions change. As long as the added cylinder clearance and process gas analysis are correct in the technology of the present application will protect the compressor. The technology of the present application also provides compressor protection through the inclusion of calculated process variables unavailable in standard systems. Cylinder blowby and degrees of reversal are two compression variables that a standard system is not capable of protecting directly.

Blowby is a measure of cylinder health and represents the efficiency of the compression taking place. Blowby increases when the monitored cylinder discharge temperature exceeds the expected cylinder temperature for the operating conditions. A blowby alarm alerts the compressor operator to a potential issue developing within a cylinder and, at high blowby levels, a shutdown can prevent further costly damage to the compressor.

By calculating the degrees of reversal of each cylinder for each full rotation of the crank, edge computer environment will insure that conditions are conducive to sufficient crosshead pin lubrication and will shut down a compressor should the conditions change and the degrees of reversal drop below the manufacturer's specified minimum. This could potentially prevent costly catastrophic failures.

The technology of the present application further provides that the edge computer environment has a control setpoint for each process variable. The purpose of the control point is to prevent alarms and, ultimately, trips in order to maximize the compressor runtime and its ability to produce gas. By default, the control setpoints should be set at the alarm setpoints to maximize the operating range.

Figure 10:
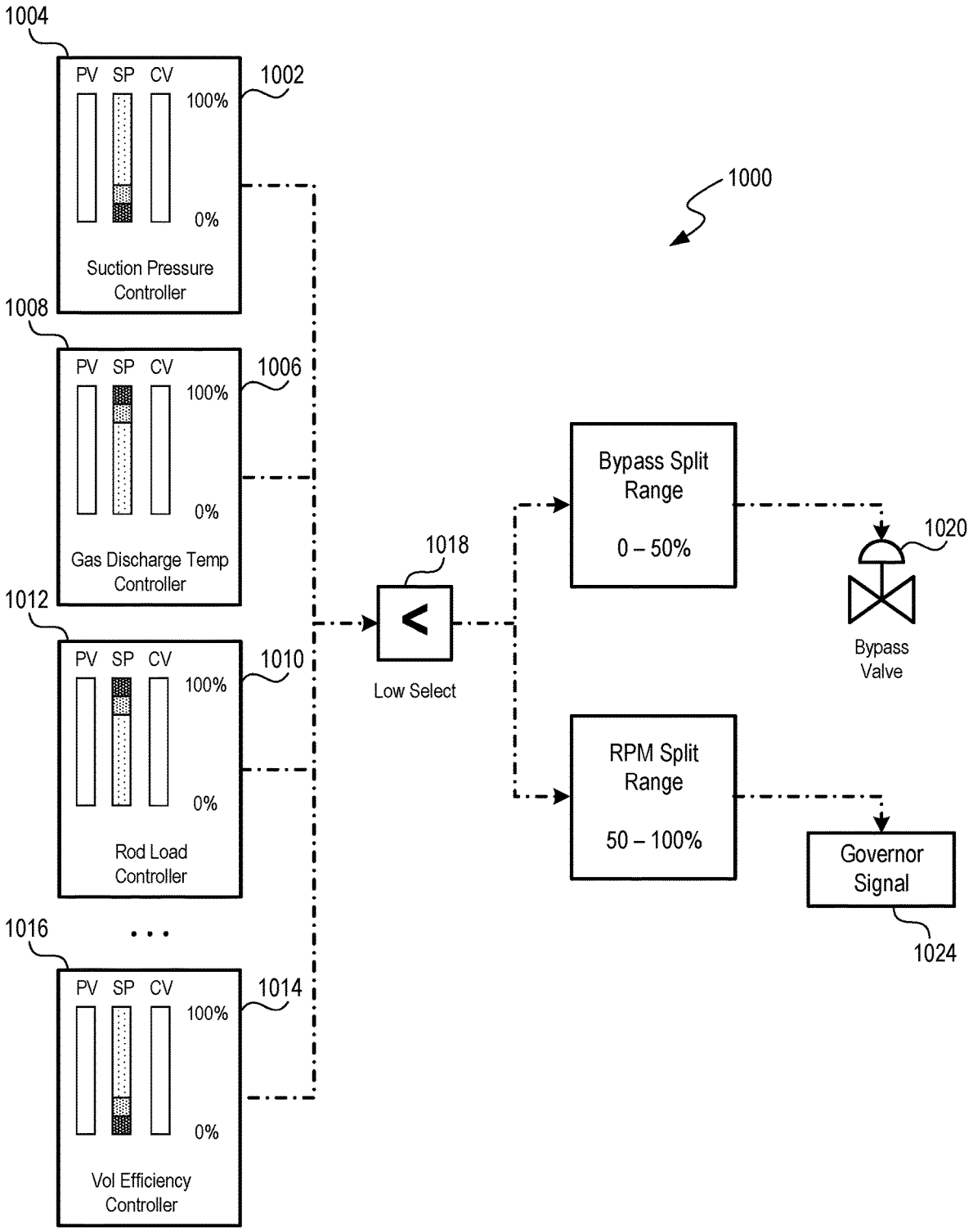
FIG. 10 shows an edge computing environment for low suction pressure capacity control.

The technology of the present application, as implemented in the edge computing environment, provides a low suction pressure capacity control 1000 as shown in FIG. 10. The low suction pressure capacity control 1000 includes a suction-gas pressure sensor 1002 and controller 1004, a discharge-gas temperature sensor 1006 and controller 1008, a rod load signal generator 1010 and controller 1012, and a volumetric efficiency signal generator 1014 and controller 1016. The sensors and controllers (1002, 1006, 1004, 1008) and the signal generators and controllers (1010, 1014, 1012, 1016) provide input to the low suction pressure control 1018 that generates a control signal to control the throttle position on the bypass valve 1020 or the governor position 1022 to control the speed. While shown as separate components, the controllers may be incorporated into the sensors, signal generators, or low suction pressure control. As can be appreciated the low suction pressure capacity control 1000 adds gas discharge-gas temperature sensor 1006 and controller 1008, rod load signal generator 1010 and controller 1012, and volumetric efficiency signal generator 1014 and controller 1016 to the standard low suction pressure capacity control 700. It also removes discharge pressure from this control loop, which will be explained below. Note that each control variable applies to each cylinder on the compressor and includes all calculated rod load process variables, static and dynamic. Each of the variables in this control loop are responsive to manipulation of suction pressure through reduction in speed and/or opening the recycle valve. Upon reaching a control setpoint on any variable the control loop will signal the required response from the governor for a reduction in driver RPM and/or the recycle valve to open to prevent further reductions in suction pressure. Like a standard system, the primary response is to reduce driver RPM followed by opening the recycle valve. This is done to minimize driver energy consumption, as recycling gas requires work to be done on the full volume of compressed gas, which then expands back to suction pressure across the recycle valve Inclusion of the gas discharge temperature, rod loads and volumetric efficiency to the low suction pressure control loop allows the low suction gas pressure setpoint to be set significantly lower than in standard systems. This is because the high gas discharge temperatures, rod loads and volumetric efficiencies are each protected by their own unique control setpoint. This allows the compressor to operate to lower suction pressures, stimulating well deliverability and increasing total recoverable resources.

Figure 11:
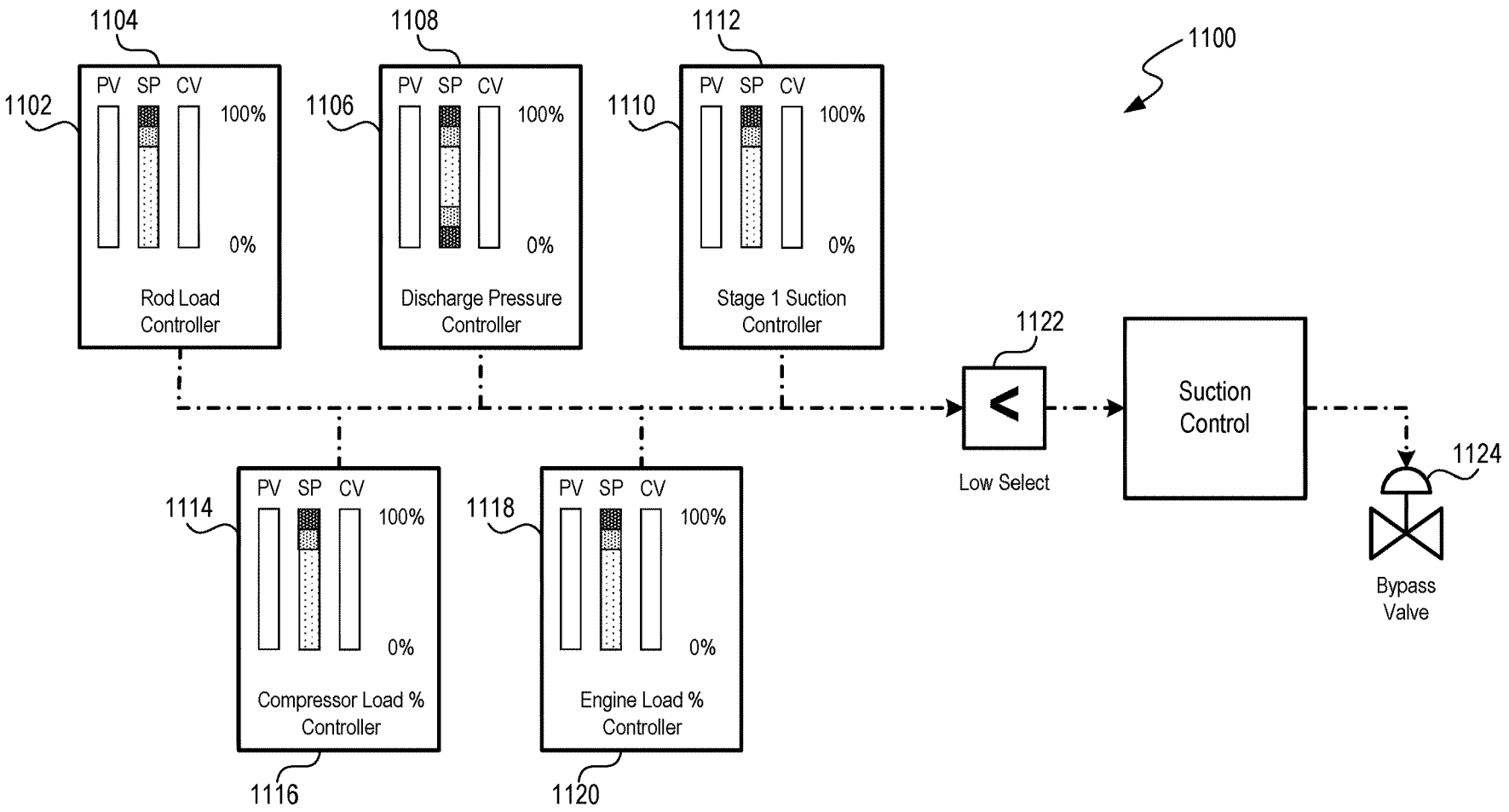
FIG. 11 shows the edge computing environment for a suction control valve system.

The technology of the present application, as implemented in the edge computing environment, provides a suction control valve system 1100 as shown in FIG. 11. The suction control valve system 1100 includes a rod load signal generator 1102 and controller 1104, a discharge-gas pressure sensor 1106 and controller 1108, a suction-gas pressure sensor 1110 and controller 1112, a compressor load signal generator 1114 and controller 1116, and an engine load sensor 1118 and controller 1120. The sensors and controllers as well as the signal generators and controllers provide data input to the suction control valve processor 1122 that sends a signal to control the throttle position of the suction control valve 1124. The suction control valve system 1100 increases the control robustness by adding engine load, compressor load, discharge pressure and rod loads to the standard high suction pressure control loop 800. This allows the high Stage 1 pressure limit to be increased to protect against the lowest MAWP of the suction system, instead of having to protect against high engine load, high compressor load, high road load and suction vessel MAWP. Within the edge computer environment, the technology of the present application provides that a well-designed compressor package should not see the suction control valve start to close upon rising suction pressure until the engine is fully loaded. This means that the compressor can maximize throughput at normal operating conditions, whereas a static high suction control pressure designed for the worst-case conditions would close the suction control valve and limit capacity at some lower suction pressure.

In situations of elevated discharge pressures, it may be required to limit further increases of discharge pressure. This may be due to limitations of the compressor package, upstream facilities, discharge pipeline or any other operational restriction. This can be achieved by reducing the throughput of the compressor, thereby producing less gas into the downstream gathering system. The discharge pressure can be maintained if the deliverability of all upstream equipment matches the take-away capacity of all downstream equipment. Inclusion of high discharge pressure in this control loop will see the suction control valve close to reduce capacity of the compressor once the high discharge pressure control point is reached. This is desirable in situation of high capacity, as a reduction in speed, which is the response of standard control systems, may see an increase in driver load. Reducing the suction pressure while maintaining full RPM will result in a reduction in load, insuring driver operation within its rated limits.

If the required reduction in capacity is large, the suction pressure may decline to the point where one of the low suction pressure control points is reached. At this point in time, a signal will be sent to the governor to reduce RPM and prevent further decrease in suction pressure. This would be followed by the recycle valve opening. If further capacity reduction is still required, a shutdown setpoint may be reached and the compressor will trip.

Figure 12:
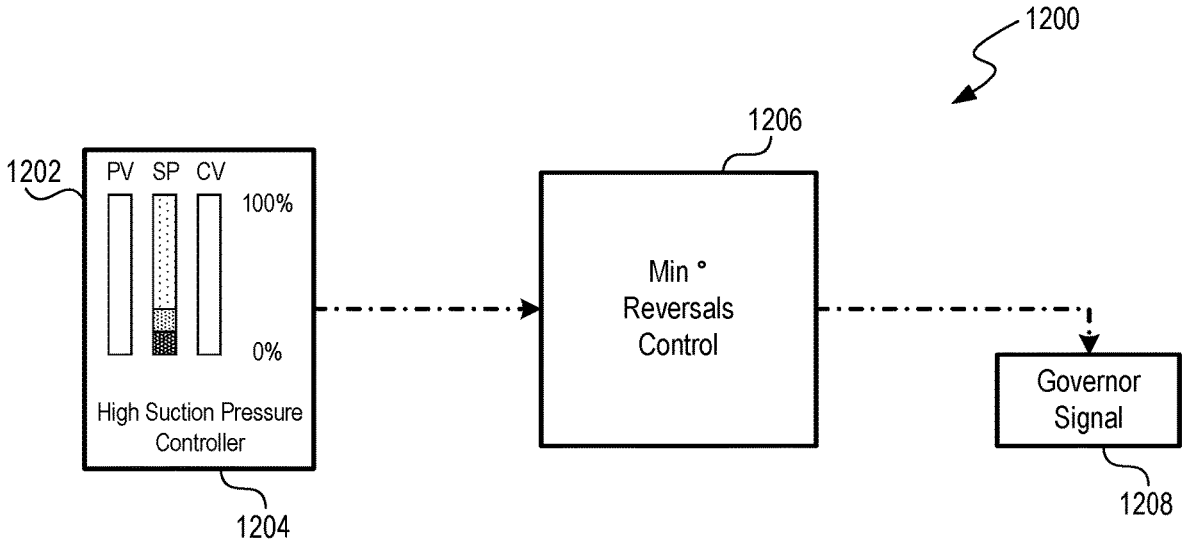
FIG. 12 shows a rod reversal controller.
Figure 13:
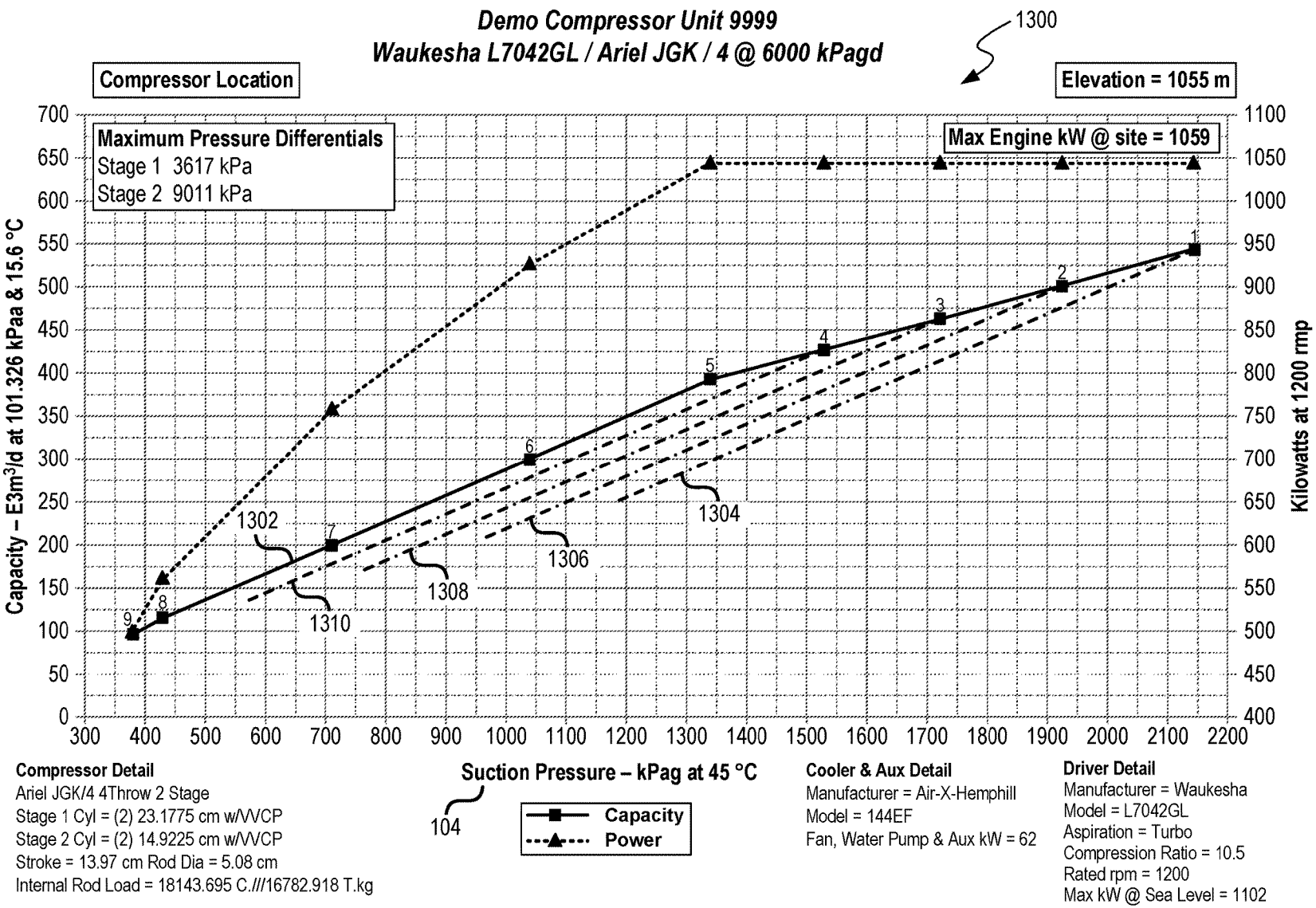
FIG. 13 shows compressor performance curves for an exemplary compressor.

The technology of the present application calculates the degrees of reversal for each cylinder of the compressor. Reversals occur every full rotation of the compressor crank shaft in order to achieve proper lubrication of the cross-head pin. Although rod reversals will usually remain high under normal double-acting operation, the following occurrences will result in a decrease in reversals:

Single-Acting Cylinders
Low RPM
Damaged Discharge Valves
High Compression Ratios
Low Volumetric Efficiencies.
Small Cylinder Bores with Large Piston Rods If the calculated degrees of reversal of any cylinder fall below the minimum threshold, an increase in driver RPM will result in an increase of reversals on all cylinders A rod reversal controller 1200 is shown in FIG. 12. The rod reversal controller 1200 provides a degrees of reversal signal generator 1202 and controller 1204 that provides a signal to the reversal controller 1206. The reversal controller 1206 provides a signal to the governor 1208 to increase or decrease speed as necessary. Should the minimum control setpoint be reached, a signal is sent to the driver governor to increase speed to maintain the minimum required degrees of reversal. This is effective because the most common occurrence of low degrees of reversal occurs on units that have been crippled for reduced throughput by single-acting cylinders and running at low RPM. Loss of reversals due to damaged discharge valves is inhibited by technology of the present application through monitoring of the calculated blowby process variable for potential valve failure.

FIG. 1, above, describes a compressor performance curve 100. FIG. 1300 shows a compressor performance curve 1300 with certain additional information. As can be appreciated from the earlier description, the flow or capacity curve 1302 includes points 1, 2, 3, 4, 5, 6, 7, 8, and 9. While the VVCPs remained closed between points 5-6-7-8, points 1-2-3-4 and 9 were obtained by adding a set amount of clearance to the cylinders through precise pocket positions. As a result, at any time a compressor has a performance curve 1304, 1306, 1308, and 1310 specific to the current configuration. This is illustrated by the dotted lines extending from points 1, 2, 3 and 4 in the performance curve in the figure below. However, reciprocating compressors can only be fully optimized for maximum throughput if either the cylinder capacity use or the power use, or both, is 100%. Therefore, the dotted lines represent operation that is not fully optimized.

For actual compressor performance to remain on the optimized performance curve, continual adjustment of the pockets would be required. Although this is impractical with conventional manual VVCPs, there are several electronic and pneumatically controlled, infinitely-variable volume clearance pockets available. A compressor equipped with automated VCPs (aVCP) always has the potential to be fully optimized using the technology of the present application as the controls are calculated using the compressor analytic software packages associated with the technology of the present application. For example, the technology of the present application for dynamic compressor controls can add the control logic for actuation of aVCPs.

Figure 14:
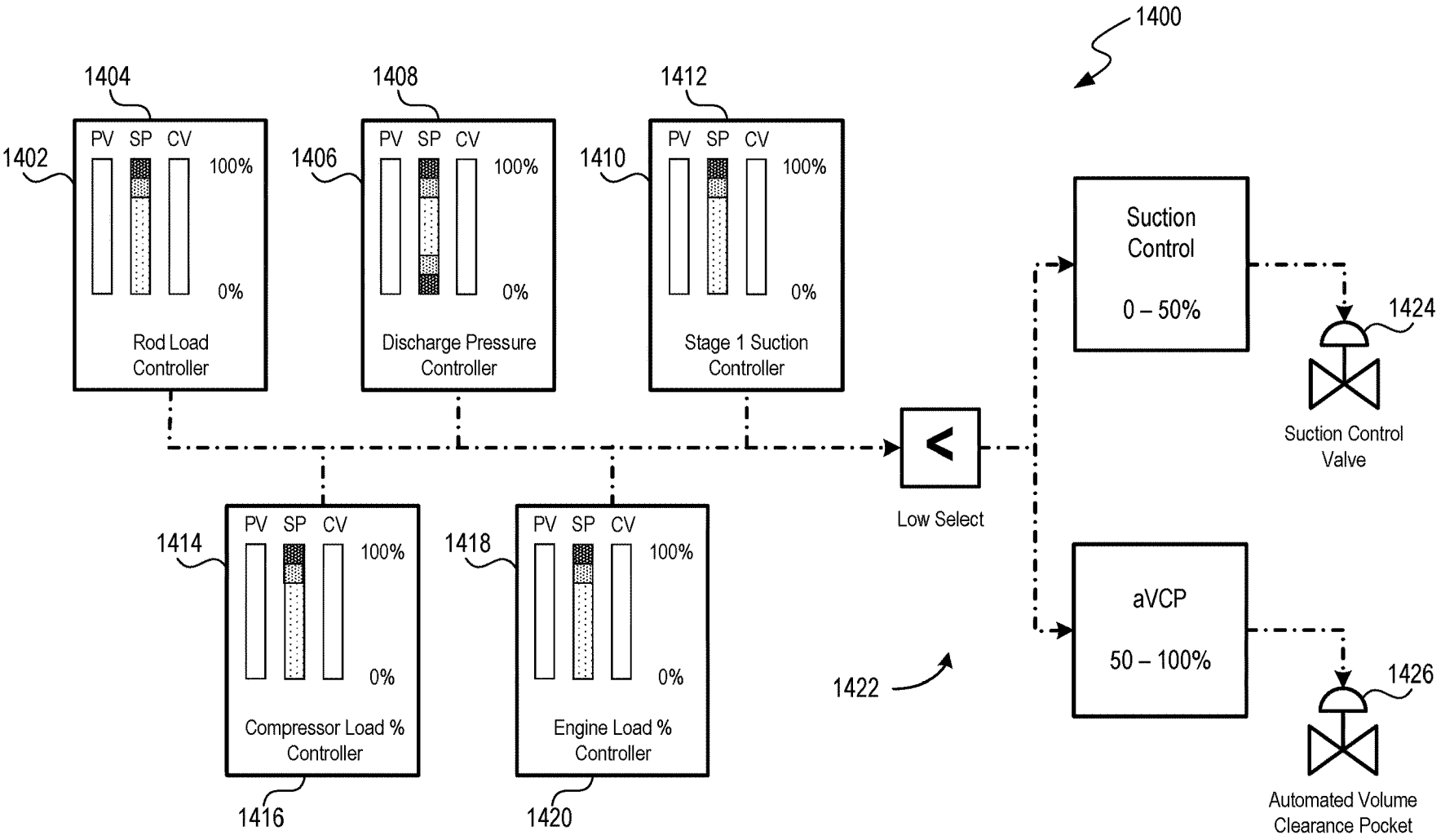
FIG. 14 shows an aVCP controller.
Figure 15:
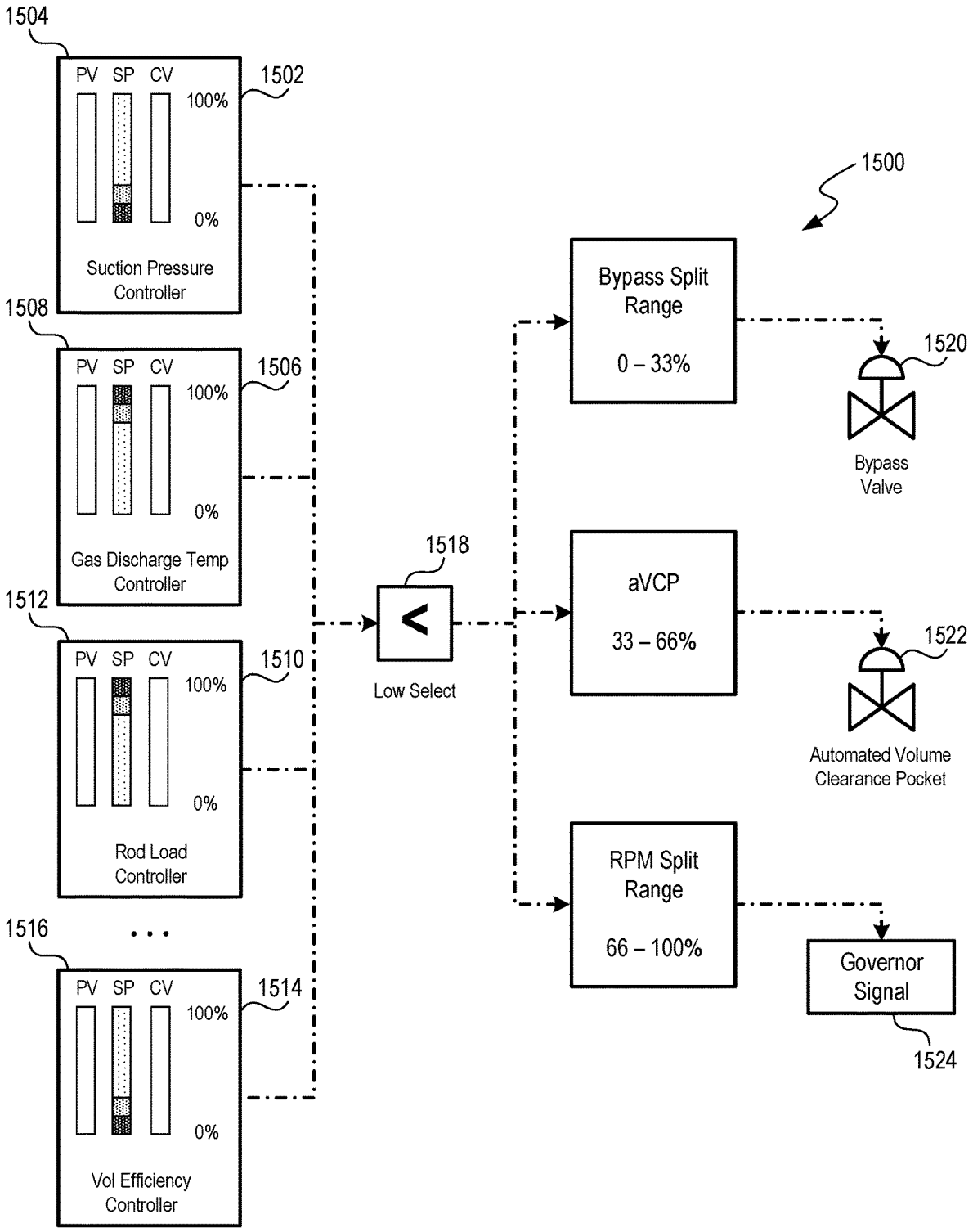
FIG. 15 shows another aVCP controller.

Rises in field deliverability result in increased compressor suction pressure and power requirements. Once the driver is fully loaded, the controller adjusts the aVCPs to maintain full driver load while matching compressor capacity with field deliverability, rather than closing the suction control valve. The suction control valve will only close once the pockets are fully opened or another control setpoint requires that suction pressure be maintained. This control logic of the aVCP controller 1400 is shown in FIG. 14. The aVCP controller 1400 includes a rod load signal generator 1402 and controller 1404, a discharge-gas pressure sensor 1406 and controller 1408, a suction-gas pressure sensor 1410 and controller 1412, a compressor load signal generator 1414 and controller 1416, and an engine load sensor 1418 and controller 1420 all of which provide data to the aVCP process control 1422 that adjusts the suction control valve 1424 or the automated volume clearance pocket valve 1426. For low flow conditions, the aVCP controller 1400 will reduce the driver RPM as an initial response but adds the ability to open the pockets before opening the recycle valve, saving on valuable fuel or electricity. The aVCP controller 1500 including the RPM or governor control is shown in FIG. 15. The aVCP controller includes a suction-gas pressure sensor 1502 and controller 1504, a discharge-gas temperature sensor 1506 and controller 1508, a rod load signal generator 1510 and controller 1512, and a volumetric efficiency signal generator 1514 and controller 1516 all of which provide data to the aVCP process control 1518 that adjusts the bypass valve 1520, the automated volume clearance pocket 1522, or the speed by adjusting the governor controller 1524.

The technology of the present application provides for operation of the compressor and the associated control systems in the optimal states. This results in an increase, and ideally maximum, throughput and decrease, and ideally minimal, energy consumption during the operation of the compressor.

Those of skill would further appreciate that the various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention. The above identified components and modules may be superseded by new technologies as advancements to computer technology continue.

The various illustrative logical blocks, modules, and circuits described in connection with the embodiments disclosed herein may be implemented or performed with a general purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A dynamic compressor capacity control for a compressor comprising, a compressor having a variable speed driver;

a hub operatively connected to the compressor to receive sensor inputs regarding a plurality of real-time operating parameters of the compressor;

a compressor analytic software package resident in the hub, the compressor analytic software package uses the sensor inputs received by the hub to dynamically calculate signal generator data that are key performance indicators for the compressor and setting at least one control point based on at least one of the sensor inputs, the signal generator data, or a combination thereof; and a dynamic compressor capacity control processor operatively coupled to the hub and the compressor analytic software package to receive the at least one control point, wherein the dynamic compressor capacity control processor generates a control signal that controls at least one of a position of a suction control valve, a position of a recycle valve, a driver speed of the variable speed driver, or a combination thereof to maintain operation of the compressor at the control point.

2. The dynamic compressor capacity control of claim 1, wherein the control signal controls the suction control valve in a close direction.

3. The dynamic compressor capacity control of claim 1, wherein the control signal controls the recycle valve in an open direction.

4. The dynamic compressor capacity control of claim 1, wherein the control signal controls the driver speed to at least one of increase revolutions per minute (RPM) or decrease RPM.

5. The dynamic compressor capacity control of claim 3, wherein the control signal decreases the driver speed to a minimum RPM prior to controlling the recycle valve in the open direction.

6. The dynamic compressor capacity control of claim 5, wherein the control signal controls the suction control valve in a close direction subsequent to decreasing the driver speed to the minimum RPM and prior to controlling the recycle valve in the open direction.

7. The dynamic compressor capacity control of claim 1, wherein the compressor analytic software package uses the sensor inputs received by the hub to dynamically calculate the signal generator data that are the key performance indicators for the compressor and determine at least a first threshold associated with each of the sensor inputs and a first threshold associated with each the signal generator data, and wherein the dynamic compressor capacity control processor operatively coupled to the hub and the compressor analytic software package generates a control signal associated with each of the sensor inputs and a control signal associated with each of the signal generator data, the associated control signals controls the operation of the compressor based on comparing whether each of the sensor inputs violates the associated first threshold or each of the signal generator data violates the associated first threshold, wherein the compressor is operated within the first threshold associated with each of the sensor inputs and the first threshold associated with each of the signal generator data based on the at least one control point.

8. The dynamic compressor capacity control of claim 7, wherein the at least one control point equals one of the first thresholds.

9. The dynamic compressor capacity control of claim 7, wherein the compressor software analytic package calculates a second threshold associated with each of the sensor inputs and generates a second threshold associated with each of the signal generator data, each second threshold being different than the associated first threshold, and wherein the dynamic compressor capacity control processor generates the associated control signals based on comparing whether each of the sensor inputs violates the associated second threshold or the signal generator data violates the associated second threshold.

10. The dynamic compressor capacity control of claim 9, wherein the at least one control point equals one of the second thresholds.

11. A dynamic compressor capacity control for a compressor comprising, a hub operatively connected to a compressor to receive sensor inputs regarding a plurality of real-time operating parameters of the compressor;

a compressor analytic software package resident in the hub, the compressor analytic software package uses the sensor inputs received by the hub to dynamically calculate signal generator data that are key performance indicators for the compressor and determine at least a first threshold associated with each of the sensor inputs and a first threshold associated with each of the signal generator data, and setting at least one control point; and a dynamic compressor capacity control processor operatively coupled to the hub and the compressor analytic software package generates a capacity control signal to modulate at least one of a suction control valve, a recycle valve, a driver speed, or a combination thereof to maintain operation of the compressor at the at least one control point and wherein the dynamic compressor capacity control processor generates a shutdown control signal associated with each of the sensor inputs and a shutdown control signal associated with each of the signal generator data based on comparing whether each of the sensor inputs violates the associated first threshold or each of the signal generator data violates the associated first threshold, such that the compressor is operated within the associated first threshold for each of the sensor inputs and within the associated first threshold for each of the signal generator data based on the at least one control point and the compressor is shutdown by the associated shutdown control signal when the compressor is operated outside the associated first threshold for one of the sensor inputs and outside the associated first threshold for one of the signal generator data.

12. The dynamic compressor capacity control of claim 11, wherein the control signal modulates the suction control valve in a close direction.

13. The dynamic compressor capacity control of claim 11, wherein the capacity control signal modulates the recycle valve in an open direction.

14. The dynamic compressor capacity control of claim 11, wherein the capacity control signal modulates the driver speed to at least one of increase revolutions per minute (RPM) or decrease RPM.

15. The dynamic compressor capacity control of claim 13, wherein the capacity control signal decreases the driver speed to a minimum RPM prior to modulating the recycle valve in the open direction.

16. The dynamic compressor capacity control of claim 15, wherein the capacity control signal modulates the suction control valve in a close direction subsequent to decreasing the driver speed to the minimum RPM and prior to modulating the recycle valve in the open direction.

17. The dynamic compressor capacity control of claim 11, wherein the compressor software analytic package calculates a second threshold associated with each of the sensor inputs and generates a second threshold associated with each of the signal generator data, each second threshold being different than the associated first threshold, and wherein the dynamic compressor capacity control processor generates the associated control signals based on comparing whether each of the sensor inputs violates the associated second threshold or each of the signal generator data violates the associated second threshold.

18. The dynamic compressor capacity control of claim 17, wherein the at least one control point is equal to one of the second thresholds.

19. A dynamic compressor capacity control for a compressor comprising, a hub operatively connected to a compressor to receive sensor inputs regarding a plurality of real-time operating parameters of the compressor;

a compressor analytic software package resident in the hub, the compressor analytic software package uses the sensor inputs received by the hub to dynamically calculate signal generator data that are key performance indicators for the compressor and determine at least a first threshold and a second threshold associated with each of the sensor inputs and a first threshold associated with each the signal generator data, and setting at least one control point; and a dynamic compressor capacity control processor operatively coupled to the hub and the compressor analytic software package generates a capacity control signal to modulate at least one of a suction control valve, a recycle valve, a driver speed, or a combination thereof to maintain operation of the compressor at the at least one control point and wherein the dynamic compressor capacity control processor generates a shutdown control signal associated with each of the sensor inputs and a shutdown control signal associated with each of the signal generator data based on comparing whether each of the sensor inputs violates the associated first threshold or each of the signal generator data violates the associated first threshold, the associated shutdown control signal generates an alarm if the compressor is operated in violation of at least one second threshold, and the compressor is shutdown by the shutdown control signal when the compressor is operated in violation of the at least one of the associated first thresholds.

20. The dynamic compressor capacity control of claim 19, wherein the at least one control point equals one of the second thresholds.

21. The dynamic compressor capacity control of claim 19, wherein the capacity control signal modulates the suction control valve in a close direction, the capacity control signal modulates the recycle valve in an open direction, and the control signal modulates the driver speed to at least one of increase revolutions per minute (RPM) or decrease RPM.

* * * * *